US010047662B2

(12) United States Patent
Takahashi et al.

(10) Patent No.: US 10,047,662 B2
(45) Date of Patent: Aug. 14, 2018

(54) COOLING SYSTEM FOR ENGINE

(71) Applicant: Mazda Motor Corporation, Aki-gun, Hiroshima (JP)

(72) Inventors: Kotaro Takahashi, Hiroshima (JP); Nobuo Yunoki, Aki-gun (JP); Masahiro Naito, Hiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 105 days.

(21) Appl. No.: 14/830,621

(22) Filed: Aug. 19, 2015

(65) Prior Publication Data

US 2016/0090896 A1 Mar. 31, 2016

(30) Foreign Application Priority Data

Sep. 25, 2014 (JP) ..... 2014-195504

(51) Int. Cl.
*F01P 7/14* (2006.01)
*F01P 7/16* (2006.01)
*F01P 3/20* (2006.01)

(52) U.S. Cl.
CPC ..... *F01P 7/165* (2013.01); *F01P 3/20* (2013.01); *F01P 2007/146* (2013.01); *F01P 2025/33* (2013.01)

(58) Field of Classification Search
CPC ..... F28F 9/26; F01P 2007/146; F01P 7/14; F01P 3/00; F01P 5/10; F01P 7/16; F01P 2003/024; F01P 2003/027; F01P 2025/33; F01P 2037/00; F01P 7/00; B60H 2001/00307
USPC ..... 123/41.01, 41.02, 41.08, 41.29, 41.31, 123/41.4, 41.44
See application file for complete search history.

(56) References Cited

U.S. PATENT DOCUMENTS 5,809,944 A * 9/1998 Aoki ..... B60H 1/00878 123/41.02
6,164,248 A * 12/2000 Lehmann ..... F01P 5/10 123/41.1
6,539,899 B1 * 4/2003 Piccirilli ..... F01P 7/167 123/41.08

(Continued)

FOREIGN PATENT DOCUMENTS

JP H06280564 A 10/1994
JP 2007205197 A 8/2007

(Continued)

*Primary Examiner* — Marguerite McMahon
*Assistant Examiner* — Tea Holbrook
(74) *Attorney, Agent, or Firm* — Alleman Hall Creasman & Tuttle LLP

(57) ABSTRACT

A cooling system for an engine is provided. The cooling system includes coolant flow paths including a first flow path and a second flow path and where coolant circulates, a coolant pump for circulating coolant within the coolant flow paths, a flow rate control valve for adjusting a flow rate of the coolant through the second flow path, a temperature detector for detecting a temperature of the coolant within the first flow path, and a valve controller for adjusting an opening of the flow rate control valve based on the temperature detected by the temperature detector. The first flow path passes through a cylinder head of the engine, and the second flow path branches from the first flow path and passes through auxiliary machinery of the engine.

16 Claims, 10 Drawing Sheets

(56) References Cited

U.S. PATENT DOCUMENTS 6,745,995 B2 * 6/2004 Hu ..... F01P 7/167 123/41.08
7,984,700 B2 * 7/2011 Chanfreau ..... B60H 1/00485 123/41.08
8,347,831 B2 * 1/2013 Vacca ..... F16K 11/085 123/41.08
9,518,503 B2 * 12/2016 Tsuchiya ..... F01P 7/14
9,523,307 B2 * 12/2016 Lee ..... F01P 7/165
2004/0154671 A1 * 8/2004 Martins ..... B60H 1/00485 137/625.47
2005/0034688 A1 * 2/2005 Lelkes ..... F01P 7/167 123/41.01
2008/0295785 A1 * 12/2008 Harris ..... F01P 7/165 123/41.08
2008/0295791 A1 * 12/2008 Holler ..... F01P 11/20 123/142.5 R
2010/0282190 A1 * 11/2010 Stoermer ..... F16K 11/0856 123/41.08
2013/0047940 A1 * 2/2013 Quix ..... F01P 7/165 123/41.08
2014/0007824 A1 * 1/2014 Hayashi ..... F01P 7/167 123/41.01
2014/0026829 A1 * 1/2014 Tobergte ..... F01P 3/02 123/41.1
2014/0069522 A1 * 3/2014 Kuze ..... F01P 7/14 137/334
2014/0326010 A1 * 11/2014 Kawakami ..... B60H 1/323 62/222
2015/0122359 A1 * 5/2015 Tsuchiya ..... F01P 7/16 137/625.47

FOREIGN PATENT DOCUMENTS

JP 2013224643 A 10/2013
JP 2014001646 A 1/2014

* cited by examiner

COOLING SYSTEM FOR ENGINE

BACKGROUND

The present invention relates to a cooling system for an engine.

Conventionally, known cooling systems for vehicles form a plurality of coolant flow paths passing through an engine body (cylinder head or cylinder block) or auxiliary machinery (heater core, exhaust gas recirculation (EGR) device, etc.), and are provided with a flow rate control valve for controlling coolant flow rates of the respective coolant flow paths (e.g., JP2013-224643A). Such a cooling system restricts the flow of the coolant into the engine body by the flow rate control valve while the engine is being warmed up after a cold start so as to stimulate a temperature increase of the engine body. When the temperature of the engine body becomes high, the cooling system cancels the flow restriction of the coolant into the engine body so as to cool the engine body. A water pump is disposed upstream of the flow rate control valve and discharges the coolant.

During such a flow restriction, the coolant paths on the upstream side of the flow rate control valve are under a high hydraulic pressure caused by a discharging pressure of the water pump. If the flow restriction is canceled under the high hydraulic pressure, a large amount of coolant temporarily flows into the engine body and causes a temperature decrease of the engine body.

Therefore, with the cooling system of JP2013-224643A, a coolant flow path which passes through the auxiliary machinery but does not pass through the engine body (hereinafter, referred to as "the engine-bypass flow path") is provided, and the coolant is flowed into the engine-bypass flow path prior to canceling the flow restriction in the flow path passing through the engine body (hereinafter, referred to as "the through-engine flow path"). Thus, overcooling of the engine body by the introduction of the large amount of coolant due to the high hydraulic pressure on the upstream side of the flow rate control valve is suppressed.

Meanwhile, in JP2013-224643A, when the coolant is not flowing into the engine-bypass flow path (when the coolant dwells in the engine-bypass flow path without flowing), the temperature of the coolant within the engine-bypass flow path is low. Therefore, immediately after the flow rate control valve switches the flow path by the flow rate control valve to change the state where the coolant is not flowing into the engine-bypass flow path into a state where the coolant is flowing thereinto, the low-temperature coolant currently dwelling in the engine-bypass flow path without flowing flows into the engine body, and therefore, the temperature of the engine body temporarily decreases, and ignitability of the engine may degrade.

SUMMARY

The present invention is made in view of the above situations and aims to provide a cooling system for an engine which can suppress overcooling of an engine body when a flow path of coolant is switched between the engine body and auxiliary machinery after a cold start of the engine.

According to an aspect of the present invention, a cooling system for an engine is provided. The cooling system for the engine includes coolant flow paths, a coolant pump, a flow rate control valve, a temperature detector, and a valve controller. The coolant flow paths include a first flow path and a second flow path and circulate coolant therethrough, the first flow path passing through a cylinder head of the engine, the second flow path branching from the first flow path and passing through auxiliary machinery of the engine. The coolant pump circulates the coolant within the coolant flow paths. The flow rate control valve adjusts a flow rate of the coolant through the second flow path. The temperature detector detects a temperature of the coolant within the first flow path. The valve controller adjusts an opening of the flow rate control valve based on the temperature detected by the temperature detector. When the detected temperature is below a predetermined temperature threshold, the valve controller adjusts the opening of the flow rate control valve to one of zero and a predetermined small opening around zero, and when the detected temperature is one of the temperature threshold and a value thereabove, the valve controller increases the opening of the flow rate control valve to a predetermined target opening in one of a stepwise fashion and a continuous and gradual fashion.

According to this configuration, when the temperature of the coolant flowing through the cylinder head is below the temperature threshold, the opening of the flow rate control valve is adjusted to one of zero and the predetermined small opening around zero. Thus, the flow rate of the coolant flowing through the cylinder head is restricted, and the warming up of the engine is stimulated.

Further, when the temperature of the coolant flowing through the cylinder head is one of the temperature threshold and a value thereabove, the opening of the flow rate control valve is increased to the predetermined target opening in one of the stepwise fashion and the continuous and gradual fashion. Thus, the flow rate restriction of the coolant flowing through the cylinder head is gradually canceled, and a temperature decrease (overcooling) of the cylinder head can be suppressed.

Specifically, when the opening of the flow rate control valve is zero, the coolant does not flow within the second flow path, and when the opening of the flow rate control valve is the predetermined small opening around zero, the flow rate of the coolant within the second flow path is small. In both cases, the coolant warmed up by the heat of the engine after the cold start is restricted from flowing into the second flow path, and the temperature of the coolant within the second flow path is comparatively low. In such a case where the temperature of the coolant within the second flow path is low, if the opening of the flow rate control valve is increased, the flow rate of the coolant flowing through the second flow path is increased, and the amount of low-temperature coolant flowing into the first flow path is increased. However, with the above configuration, since the opening of the flow rate control valve is increased in one of the stepwise fashion and the continuous and gradual fashion, the amount of the low-temperature coolant flowing into the cylinder head is gradually increased. Therefore, the overcooling of the cylinder head is suppressed, and the degradation of the ignitability after the cold start of the engine can be suppressed.

Note that "the opening of the flow rate control valve is increased in the stepwise fashion" means that the opening of the flow rate control valve is increased intermittently in at least two steps. Further, "the opening of the flow rate control valve is increased in the continuous and gradual fashion" means that the opening of the flow rate control valve is increased comparatively moderately and continuously, and does not mean sharply and continuously.

The auxiliary machinery of the engine is preferably disposed at a downstream flow path of the first flow path, the downstream flow path located downstream of the branching point between the first and second flow paths. The flow rate control valve is preferably connected with the downstream flow path and preferably constantly maintains the opening of the valve with respect to the downstream flow path at a predetermined small opening around zero.

According to this configuration, since the opening of the flow rate control valve with respect to the downstream flow path is constantly maintained at the predetermined small opening around zero, a small amount of coolant constantly flows through the downstream flow path. Therefore, by disposing the auxiliary machinery which requires constant cooling by the coolant at the downstream flow path, overheating of the auxiliary machinery can be prevented.

The valve controller preferably opens the flow rate control valve to the second flow path at a predetermined opening that is below the target opening and maintains the opening, and when the detected temperature meets a predetermined condition while the opening of the flow rate control valve is maintained, the valve controller preferably opens the flow rate control valve to the second flow path to reach the target opening.

According to this configuration, since the valve controller opens the flow rate control valve to maintain the opening at the predetermined opening below the target opening for a while, the low-temperature coolant existing within the second flow path is gradually supplied to the cylinder head. Therefore, the overcooling of the cylinder head after the cold start of the engine can be suppressed, and the warming up of the engine can be stimulated.

The auxiliary machinery disposed at the second flow path preferably includes a heater core.

According to this configuration, although the heat of the coolant within the second flow path is taken by the heater core, the coolant is gradually supplied to the cylinder head. Thus, the overcooling of the cylinder head after the cold start of the engine can be suppressed.

The auxiliary machinery disposed at the second flow path preferably includes a radiator.

According to this configuration, although the heat of the coolant within the second flow path is released through the radiator, the coolant is gradually supplied to the cylinder head. Thus, the overcooling of the cylinder head after the cold start of the engine can be suppressed.

The coolant flow paths also preferably include a third flow path passing through a cylinder block of the engine. The flow rate control valve preferably adjusts the flow rate of the coolant through the second and third flow paths. When the detected temperature is below a predetermined temperature threshold for the third flow path, the valve controller preferably adjusts the opening of the flow rate control valve with respect to the third flow path to one of zero and a predetermined small opening around zero, and when the detected temperature is one of the predetermined temperature threshold for the third flow path and a value thereabove, the valve controller preferably increases the opening of the flow rate control valve with respect to the third flow path to a predetermined target opening for the third flow path in one of a stepwise fashion and a continuous and gradual fashion, the predetermined temperature threshold for the third flow path being a value above the target threshold for the first flow path.

According to this configuration, the low-temperature coolant existing within the third flow path when the opening of the flow rate control valve with respect to the third flow path is one of zero and the predetermined small opening around zero, is supplied to the cylinder head and the cylinder block gradually by increasing the opening of the flow rate control valve in one of the stepwise fashion and the continuous and gradual fashion. Thus, the overcooling of the cylinder head and the cylinder block after the cold start of the engine can be suppressed.

The flow rate control valve is preferably a rotary valve for increasing the flow rate of the coolant by increasing an opening thereof.

According to this configuration, since the rotary valve for increasing the flow rate of the coolant by increasing the opening thereof is used as the flow rate control valve, the flow rate can easily be controlled.

DETAILED DESCRIPTION OF EMBODIMENT

Hereinafter, one preferred embodiment of the present invention is described in detail with reference to the appended drawings.

First, an engine 9 and an intake-and-exhaust system thereof according to this embodiment are described.

The engine 9 is a diesel engine for driving a vehicle.

Figure 1:
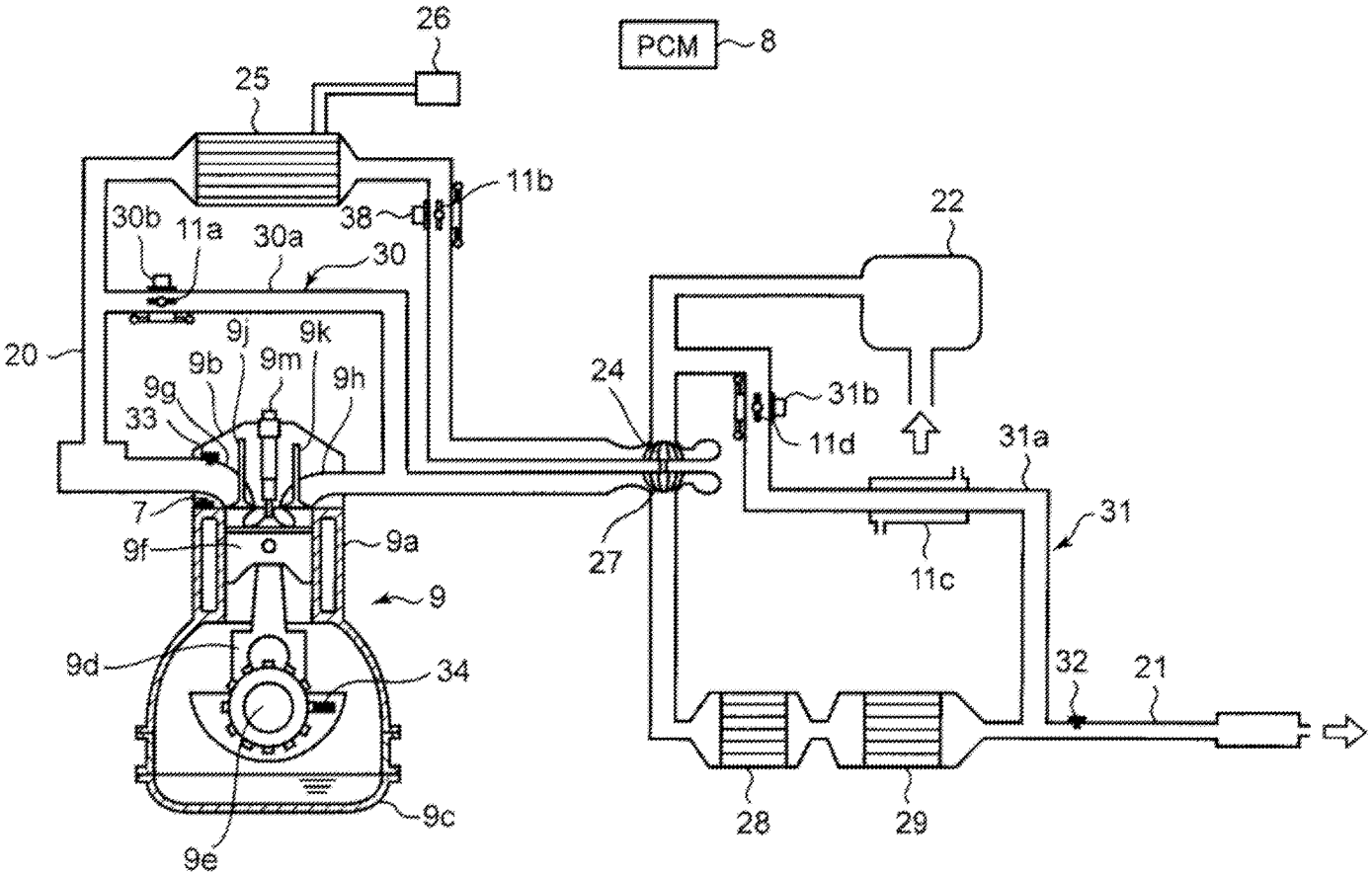
FIG. 1 is a view illustrating an engine and an intake-and-exhaust system according to an embodiment of the present invention.

The engine 9 includes a cylinder block 9*a* formed with a plurality of cylinders (only one cylinder is illustrated in FIG. 1), a cylinder head 9*b* disposed on the cylinder block 9*a*, and an oil pan 9*c* disposed below the cylinder block 9*a*.

A piston 9*f* coupled to a crankshaft 9*e* via a connecting rod 9*d* is reciprocatably fitted into each of the cylinders.

In the cylinder head 9*b*, an intake port 9*g*, and an exhaust port 9*h* are formed for each of the cylinders. An intake valve 9*j* and an exhaust valve 9*k* are disposed at the intake and exhaust ports 9*g* and 9*h*, respectively.

Further, the cylinder head 9*b* is provided with electromagnetic-type direct injectors 9*m* for injecting fuel into the respective cylinders. The fuel is supplied to the direct injectors 9*m* from a fuel tank via a fuel pump and a common rail (none of them illustrated). The common rail is provided with a fuel pressure sensor 36 (see FIG. 2) for detecting a pressure of the fuel.

The intake-and-exhaust system of the engine 9 includes an intake passage 20 for introducing intake air into the cylinders via the intake ports 9*g*, and an exhaust passage 21 for discharging outdoors exhaust gas produced within the cylinders.

The intake passage 20 is provided, in the following order from the upstream side, with an air cleaner 22 for removing dust contained within the intake air, a compressor 24 of a turbocharger, an intake shutter valve 11*b* for shutting down the intake passage 20, an intake shutter valve actuator 38 for driving the intake shutter valve 11*b*, an intercooler 25 for forcibly cooling the intake air at high pressure and temperature due to being compressed by the compressor 24, and an intercooler coolant pump 26 for sending coolant to the intercooler 25.

The exhaust passage 21 is provided, in the following order from the upstream side, with an exhaust turbine 27 of the turbocharger, a diesel oxidation catalyst (DOC) 28, a diesel particulate filter (DPF) 29 for capturing exhaust particulate matter within the exhaust gas, etc.

Further, the intake-and-exhaust system includes a high-pressure exhaust gas recirculation (EGR) device 30 and a low-pressure EGR device 31.

The high-pressure EGR device 30 includes a high-pressure EGR passage 30*a* connecting a position of the intake passage 20 upstream of the intake ports 9*g* with a position of the exhaust passage 21 downstream of the exhaust ports 9*h*, a high-pressure EGR valve 11*a* for adjusting a flow rate of high-pressure EGR gas through the high-pressure EGR passage 30*a*, and a high-pressure EGR valve actuator 30*b* for driving the high-pressure EGR valve 11*a*.

The low-pressure EGR device 31 includes a low-pressure EGR passage 31*a* connecting a position of the exhaust passage 21 downstream of the DPF 29 with a position of the intake passage 20 upstream of the compressor 24, a low-pressure EGR valve 11*d* for adjusting a flow rate of low-pressure EGR gas through the low-pressure EGR passage 31*a*, a low-pressure EGR valve actuator 31*b* for driving the low-pressure EGR valve 11*d*, and a low-pressure EGR cooler 11*c* for cooling the low-pressure EGR gas.

The engine 9 and the intake-and-exhaust system configured as above are controlled by a powertrain control module (PCM) 8. The PCM 8 is comprised of a CPU, at least one memory, an interface, etc.

Figure 2:
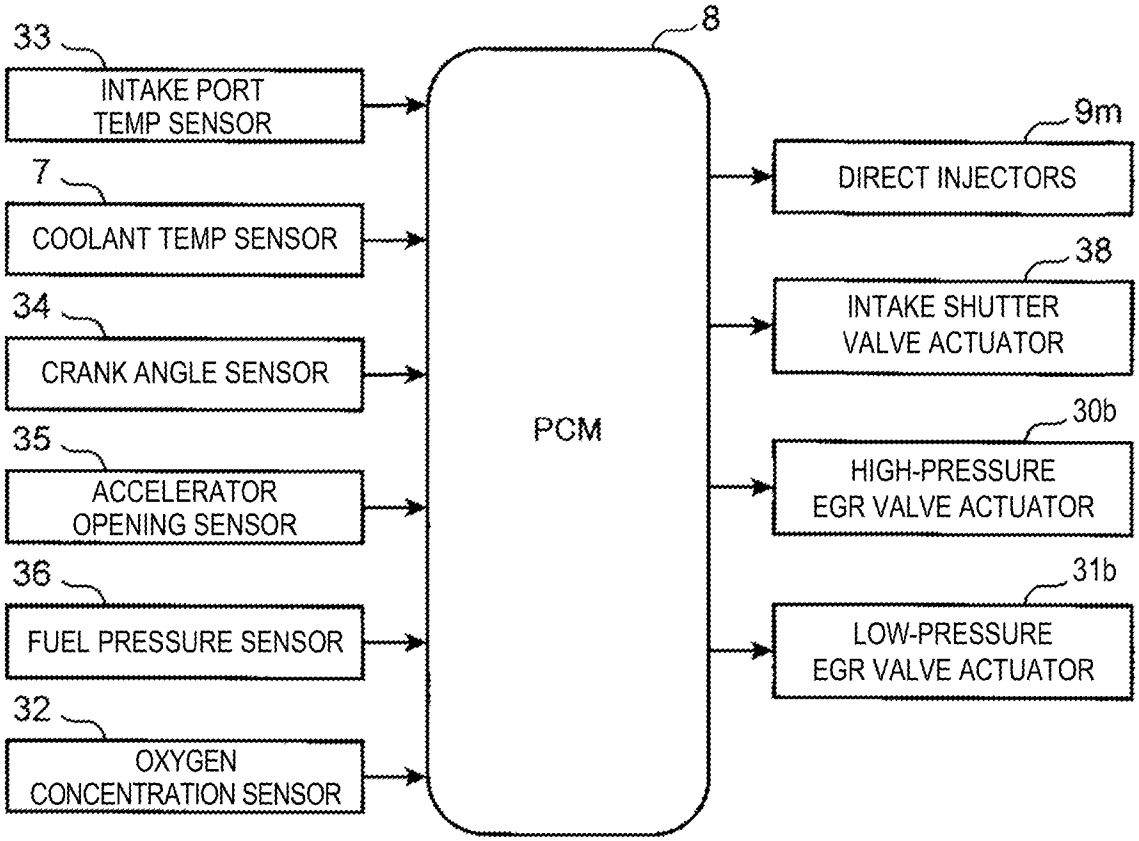
FIG. 2 is a view illustrating a PCM, an input unit, and an output unit according to the embodiment of the present invention.

As illustrated in FIG. 2, the PCM 8 receives detection signals of various sensors. The various sensors include intake port temperature sensors 33 attached to the intake ports 9*g* and for detecting temperatures of the intake air immediately before flowing into the respective cylinders (intake mixture containing intake air and exhaust gas), a coolant temperature sensor 7 for detecting a temperature of the coolant near the intake ports 9*g*, a crank angle sensor 34 for detecting a rotational angle of the crankshaft 9*e*, an accelerator opening sensor 35 for detecting an accelerator opening corresponding to an operation amount of an acceleration pedal (not illustrated) of the vehicle, the fuel pressure sensor 36 for detecting the fuel pressure to be supplied to the direct injectors 9*m*, and an oxygen concentration sensor 32 for detecting an oxygen concentration within the exhaust gas at a position downstream of the DPF 29.

The PCM 8 determines states of the engine 9, the intake-and-exhaust system and the like by performing a variety of operations based on the detection signals of the sensors, and outputs control signals to the direct injectors 9*m* and the actuators of the various valves (intake shutter valve actuator 38, high-pressure EGR valve actuator 30*b*, low-pressure EGR valve actuator 31*b*) according to the determination result.

Figure 3:
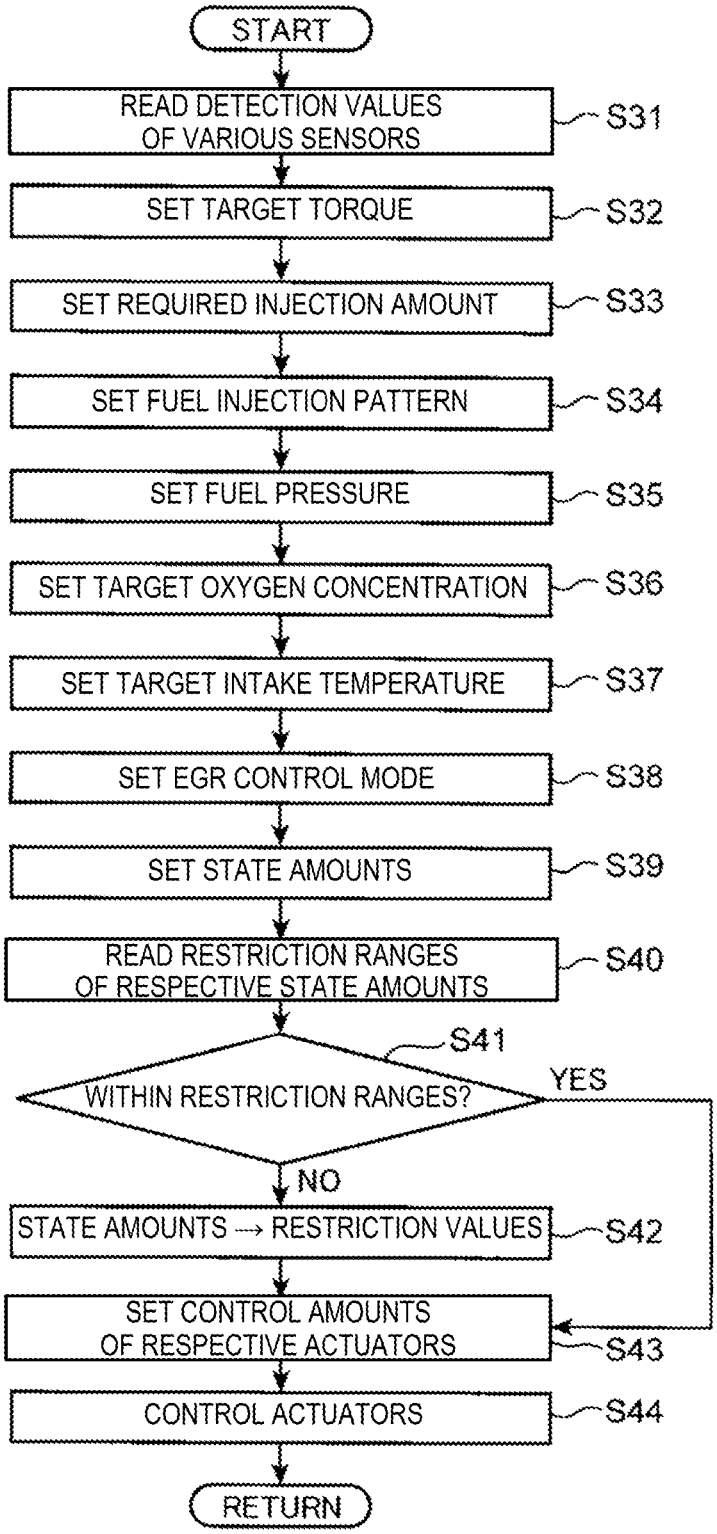
FIG. 3 is a flowchart illustrating a control of the intake-and-exhaust system of the engine according to the embodiment of the present invention.

Next, a control performed by the PCM 8 is described with reference to the flowchart of FIG. 3.

First, the PCM 8 reads the detection values of the various sensors (S31).

Subsequently, the PCM 8 calculates an engine speed based on the rotational angle detected by the crank angle sensor 34, and sets a target torque based on the engine speed and the accelerator opening detected by the accelerator opening sensor 35 (S32).

Next, the PCM 8 sets a required injection amount of fuel based on the engine speed and the target torque (S33).

Then, the PCM 8 selects a fuel injection pattern according to the required injection amount and the engine speed, from a plurality of fuel injection patterns stored in the memory beforehand (S34).

Subsequently, the PCM 8 sets a fuel pressure to be supplied to the direct injectors 9*m*, based on the required injection amount and the engine speed (S35).

Next, the PCM 8 sets a target oxygen concentration based on the required injection amount and the engine speed (S36). The target oxygen concentration is a target value of an oxygen concentration of the intake mixture immediately before flowing into the cylinders.

Then, the PCM 8 sets a target intake temperature based on the required injection amount and the engine speed (S37). The target intake temperature is a target value of a temperature of the intake mixture immediately before flowing into the cylinders.

Subsequently, the PCM 8 selects an EGR control mode according to the required injection amount and the engine speed, from a plurality of EGR control modes stored in the memory beforehand (S38). The EGR control mode is respectively selected for the high-pressure and low-pressure EGR devices 30 and 31.

Next, the PCM 8 sets state amounts (high-pressure EGR amount, low-pressure EGR amount, and turbocharging pressure) for achieving the target oxygen concentration and the target intake temperature (S39).

Then, the PCM 8 reads restriction ranges of the respective state amounts from the memory (S40). The restriction ranges are ranges which the state amounts need to meet (remain within), respectively, so that the engine 9 and the intake-and-exhaust system can suitably operate, and the restriction ranges are stored in the memory beforehand.

Subsequently, the PCM 8 determines whether the state amounts set at S39 are within the restriction ranges, respectively (S41).

If the state amounts are determined to be within the restriction ranges, respectively (S41: YES), the control proceeds to S43, where the PCM 8 sets control amounts of the direct injectors 9*m*, the intake shutter valve actuator 38, the high-pressure EGR valve actuator 30*b*, and the low-pressure EGR valve actuator 31*b* based on the state amounts set at S39, respectively.

Next, the PCM 8 controls the direct injectors 9*m*, the intake shutter valve actuator 38, the high-pressure EGR valve actuator 30*b*, and the low-pressure EGR valve actuator 31*b* based on the set control amounts, respectively (S44).

At S41, if any of the state amounts is determined to be out of the corresponding restriction range, the PCM 8 corrects the state amount to the corresponding restriction range (S42). For example, the PCM 8 corrects the state amount to a restriction value closest to the state amount set at S39 within the restriction range. After S42, the PCM 8 controls the direct injectors 9*m*, the intake shutter valve actuator 38, the high-pressure EGR valve actuator 30*b*, and the low-pressure EGR valve actuator 31*b* based on the corrected state amount (S44).

Hereinafter, the cooling system of the engine 9 according to this embodiment of the present invention is described.

Figure 4:
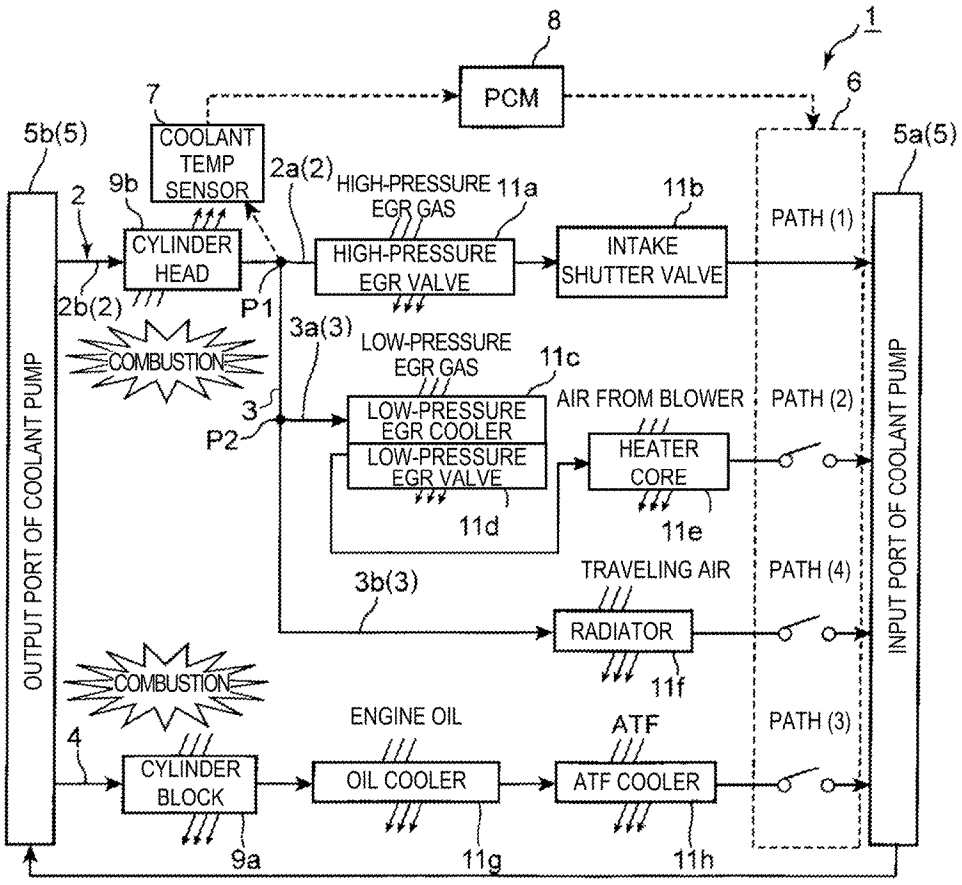
FIG. 4 is a view illustrating a cooling system of the engine according to the embodiment of the present invention.

As illustrated in FIG. 4, the cooling system 1 of the engine 9 includes coolant flow paths having a first flow path 2, a second flow path 3, and a third flow path 4, a coolant pump 5, a flow rate control valve 6, the coolant temperature sensor 7, and the PCM 8. The coolant circulates within the coolant flow paths.

The first flow path 2 passes through the cylinder head 9*b* of the engine 9. The first flow path 2 has a branch point P1 toward the second flow path 3 at a position downstream of the cylinder head 9*b*. The first flow path 2 has a first auxiliary flow path 2*a* (path (1)) at a position downstream of the branch point P1. The first auxiliary flow path 2*a* passes through the high-pressure EGR valve 11*a* and the intake shutter valve 11*b*.

The second flow path 3 passes through auxiliary machinery such as components 11*a*-11*f* of the engine 9. The second flow path 3 has a branch point P2 at a position downstream of the branch point P1. The second flow path 3 has a second auxiliary flow path 3*a* (path (2)) and a third auxiliary flow path 3*b* (path (4)), both connected with the branch point P2. The second and third auxiliary flow paths 3*a* and 3*b* are connected in parallel with each other at the branch point P2.

The second auxiliary flow path 3*a* passes through the low-pressure EGR valve 11*d*, the low-pressure EGR cooler 11*c*, and a heater core 11*e*.

The third auxiliary flow path 3*b* passes through a radiator 11*f*.

The third flow path 4 (path (3)) passes through the cylinder block 9*a* of the engine 9, an oil cooler 11*g*, and an automatic transmission fluid (ATF) cooler 11*h*.

The coolant pump 5 is a turbopump and structured such that an impeller thereof is indirectly coupled to the crankshaft 9*e* of the engine 9. An input port 5*a* of the coolant pump 5 is connected with a downstream end of the first auxiliary flow path 2*a*, a downstream end of the second auxiliary flow path 3*a*, a downstream end of the third auxiliary flow path 3*b*, and a downstream end of the third flow path 4, via the flow rate control valve 6. An output port 5*b* of the coolant pump 5 is connected with an upstream end of the first flow path 2 and an upstream end of the third flow path 4.

The coolant pump 5 sucks, via the input port 5*a*, the coolant within the first to third auxiliary flow paths 2*a*, 3*a*, and 3*b* and the third flow path 4 by pumping in accordance with the rotation of the impeller using a part of engine torque, and discharges the coolant to the first and third flow paths 2 and 4, via the output port 5*b*. The coolant sucked into the coolant pump 5 is mixed inside the coolant pump 5 before being discharged.

The flow rate control valve 6 is a single rotary valve. The flow rate control valve 6 has a cylindrical casing, a cylindrical valve body rotatably contained inside the casing, and an actuator for rotating the valve body in a single direction. The actuator rotates the valve body based on the control signals (drive voltage) inputted from the PCM 8. Four input ports and four output ports are formed in a side face of the casing. The four input ports are connected with the downstream ends of the first to third auxiliary flow paths 2*a*, 3*a*, and 3*b* and the third coolant flow path 4, respectively. The four output ports are connected with the input port 5*a* of the coolant pump 5.

Notched portions are formed in the side face of the valve body. Communication areas S formed between the notched portions and the output ports of the casing are individually set for the first to third auxiliary flow paths 2*a*, 3*a*, and 3*b* and the third flow path 4. In the following description, the communication area S for the first auxiliary flow path 2*a* is referred to as "the communication area S2*a*," the communication area S for the second auxiliary flow path 3*a* is referred to as "the communication area S3*a*," the communication area S for the third auxiliary flow path 3*b* is referred to as "the communication area S3*b*," and the communication area S for the third flow path 4 is referred to as "the communication area S4."

The communication area S2*a* is stable at a small area near zero regardless of a rotational angle of the valve body (see FIG. 5), which can control the flow rate of the coolant to as small as around zero so that the cylinder head 9*b* is not overcooled, while also securing a flow rate required for cooling the high-pressure EGR valve 11*a* and the intake shutter valve 11*b*.

Figure 5:
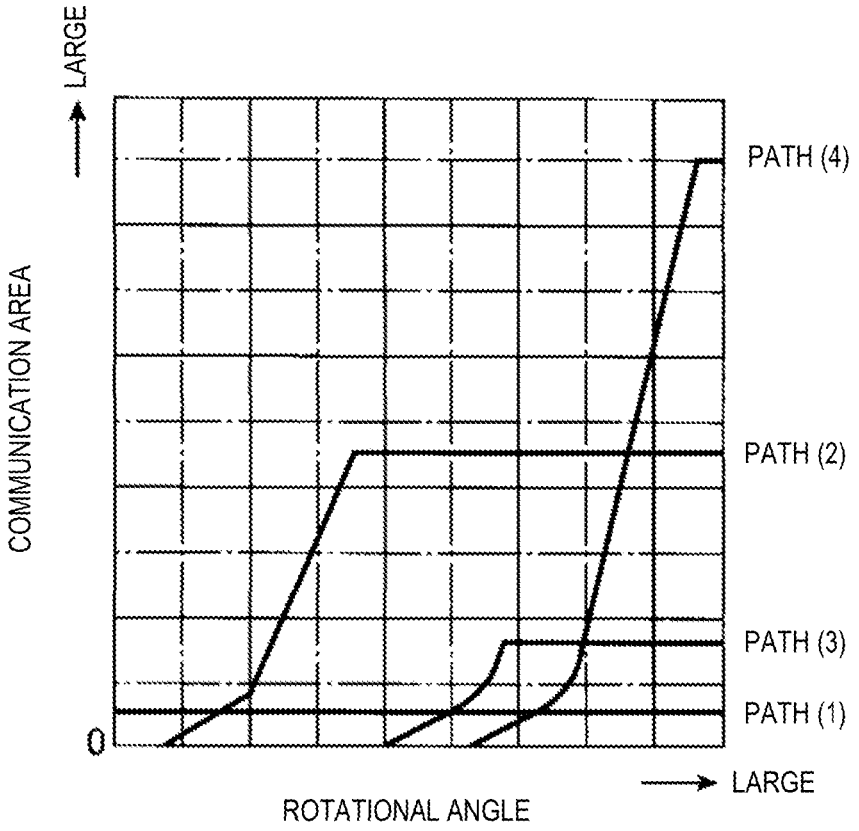
FIG. 5 is a chart illustrating relationship of a rotational angle with openings (communication areas) of a flow rate control valve according to the embodiment of the present invention.

On the other hand, the communication areas S3*a*, S3*b*, and S4 vary according to the rotational angle of the valve body (see FIG. 5).

In other words, the flow rate of the coolant through the second auxiliary flow path 3*a* is changed according to the variation of the communication area S3*a* (hereinafter, referred to as "the opening of the flow rate control valve 6 with respect to the second auxiliary flow path 3*a*").

Further, the flow rate of the coolant through the third auxiliary flow path 3*b* is changed according to the variation of the communication area S3*b* (hereinafter, referred to as "the opening of the flow rate control valve 6 with respect to the third auxiliary flow path 3*b*").

Further, the flow rate of the coolant through the third flow path 4 is changed according to the variation of the communication area S4 (hereinafter, referred to as "the opening of the flow rate control valve 6 with respect to the third flow path 4").

The coolant temperature sensor 7 detects the temperature of the coolant at a position of the first flow path 2, near the cylinder head 9*b*. The information of the temperature detected by the coolant temperature sensor 7 is transmitted to the PCM 8.

The PCM 8 has a valve control function to control the openings of the flow rate control valve 6 based on the temperature detected by the coolant temperature sensor 7.

Figure 6:
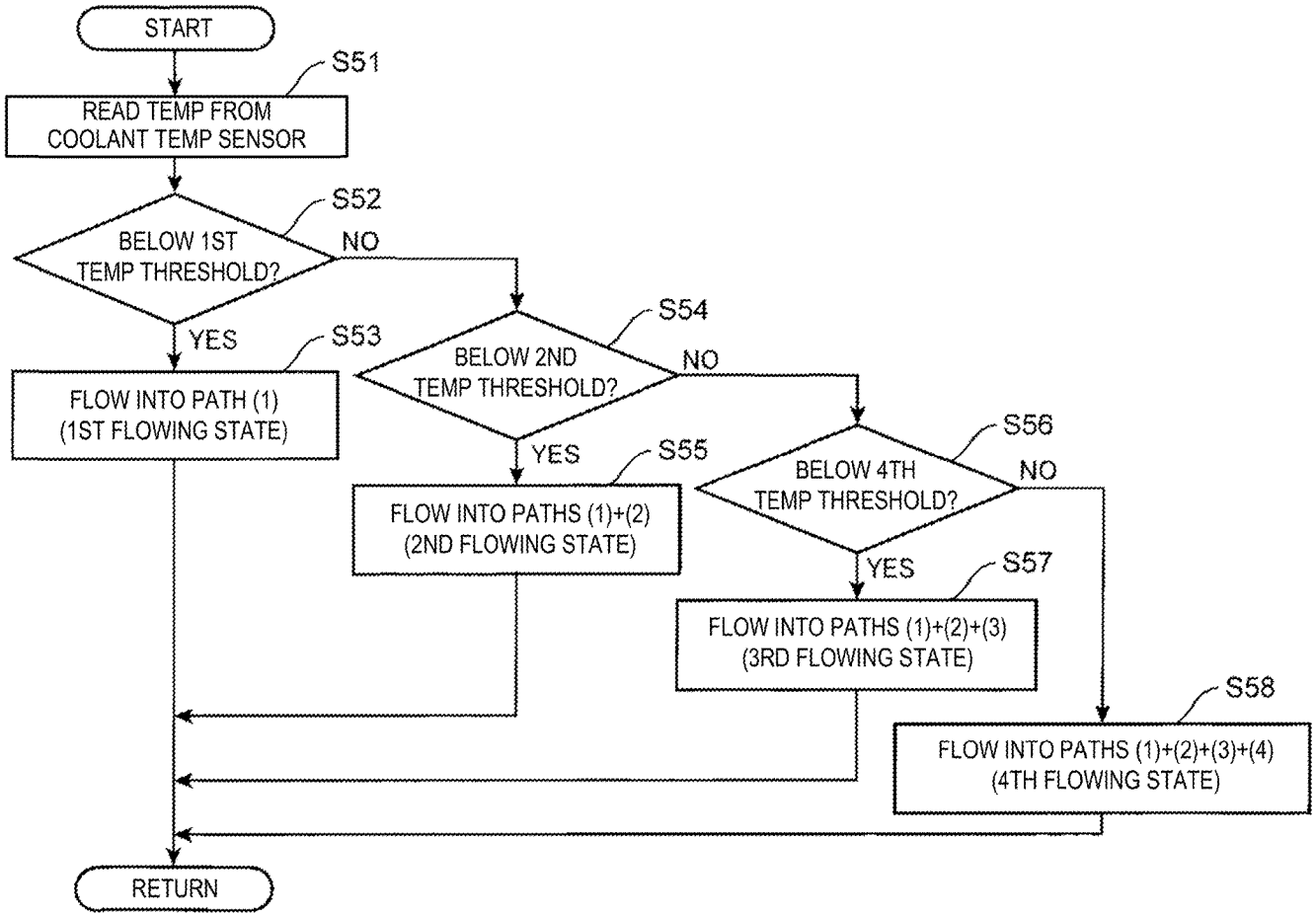
FIG. 6 is a flowchart illustrating a coolant flow switching operation among coolant flow paths according to the embodiment of the present invention.

Hereinafter, a control of the cooling system by the PCM 8 is described with reference to the flowchart of FIG. 6.

Note that, in the following description, the control is started while the openings of the flow rate control valve 6 with respect to the second and third auxiliary flow paths 3*a* and 3*b* and the third flow path 4 are zero (closed).

First, the PCM 8 receives a temperature T of the coolant near the cylinder head 9*b* from the coolant temperature sensor 7 (S51).

Figure 8:
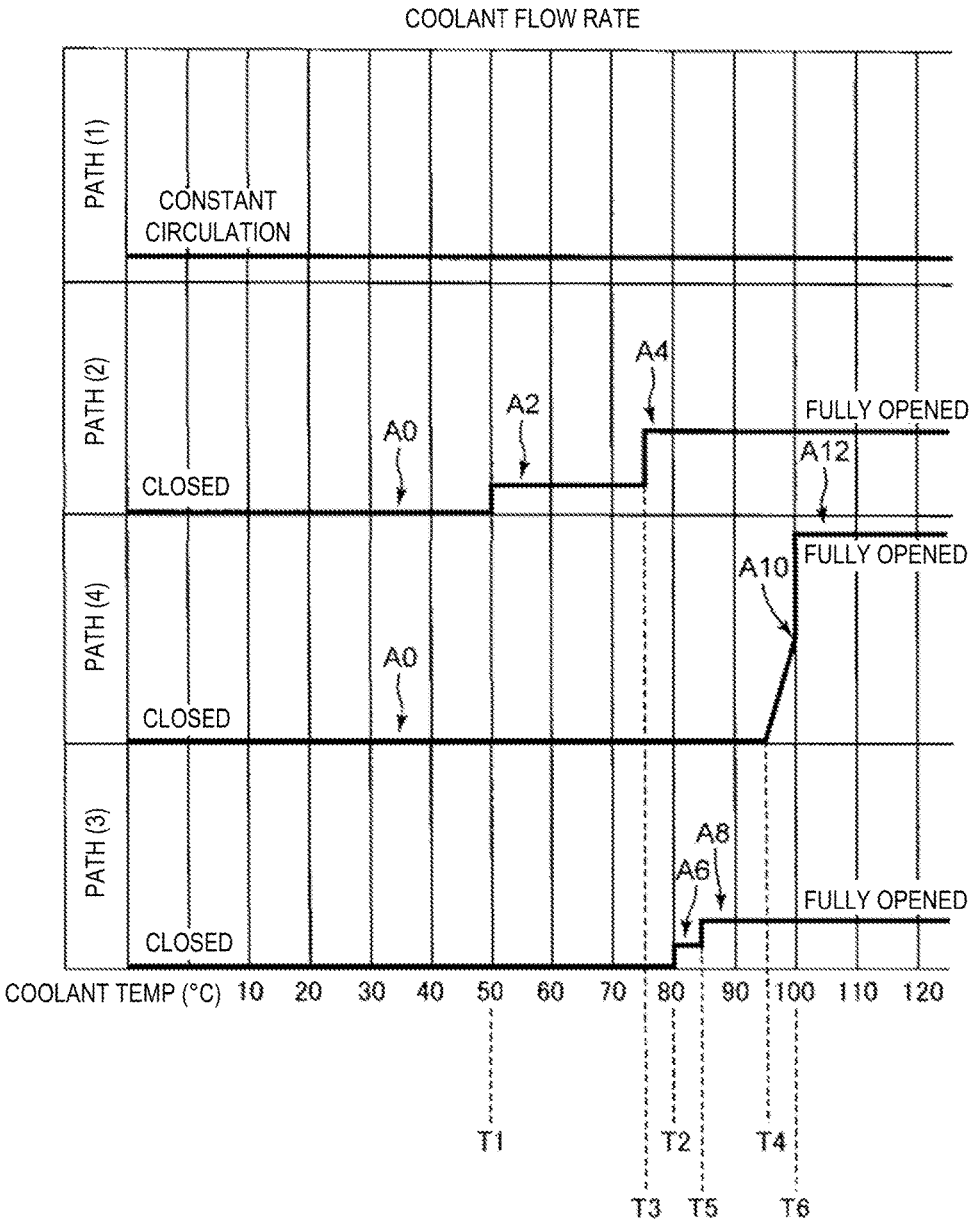
FIG. 8 shows charts illustrating timings of increasing the openings of the flow rate control valve according to the embodiment of the present invention.

Next, the PCM 8 determines whether the received temperature T is below a first temperature threshold T1 (S52). Here, the first temperature threshold T1 is below a temperature at which the engine 9 transitions from a cold state into a warmed-up state after the cold start (e.g., substantially 80° C.), in other words, a temperature while the engine warms up (before being completely warmed up), for example 50° C. (see FIG. 8).

If the temperature T is determined to be below the first temperature threshold T1 (S52: YES), at S53, the PCM 8 maintains the openings of the flow rate control valve 6 with respect to the second and third auxiliary flow paths 3*a* and 3*b* at zero (see A0 in FIG. 8) so as to restrict the flow rate of the coolant flowing through a part of the first flow path 2 on the upstream side of the branch point P1 (hereinafter, referred to as "the upstream flow path 2*b* of the first flow path 2"), in other words, the flow rate of the coolant flowing through the cylinder head 9*b*. Thus, the flow rate of the coolant flowing through the upstream flow path 2*b* of the first flow path 2 becomes equivalent to that flowing through the first auxiliary flow path 2*a* (path (1)), and is controlled to as small as around zero (see A1 in FIG. 9). Therefore, a temperature decrease of the cylinder head 9*b* is suppressed, and the temperature of the cylinder head 9*b* eventually increases (first flowing state in FIG. 9). Note that, at S53, the PCM 8 also maintains the opening of the flow rate control valve 6 with respect to the third flow path 4 at zero. Thus, the temperature decrease of the cylinder block 9*a* is further suppressed, and the temperature of the cylinder block 9*a* eventually increases. Then, the control returns to S51.

If the temperature T is determined to be the first temperature threshold T1 or higher (S52: NO), at S54, the PCM 8 determines whether the temperature T is below a second temperature threshold T2 (e.g., 80° C., see FIG. 8). Note that the second temperature threshold T2 is above the first temperature threshold T1.

If the temperature T is determined to be below the second temperature threshold T2 (S54: YES), the PCM 8 increases the opening of the flow rate control valve 6 with respect to the second auxiliary flow path 3*a* to cancel the flow rate restriction of the coolant in the first flow path 2 (S55). Then, the control returns to S51.

Figure 7:
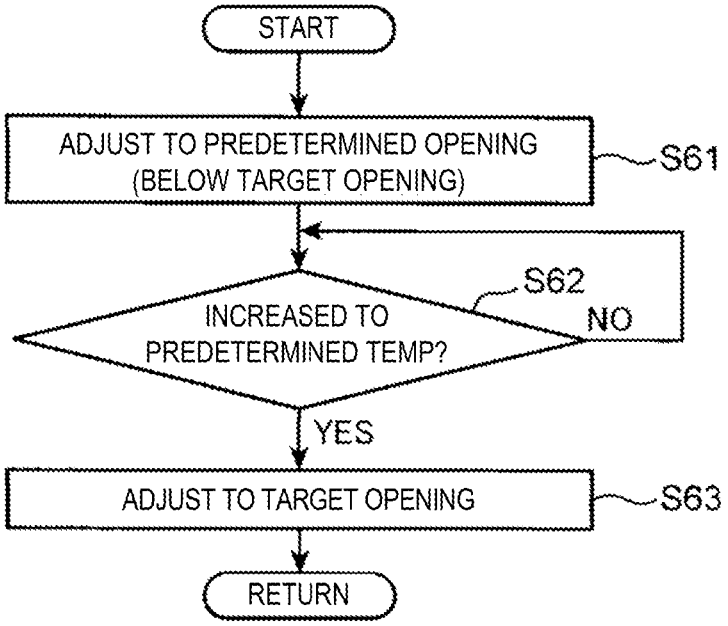
FIG. 7 is a flowchart illustrating an open control of the flow rate control valve in a stepwise fashion according to the embodiment of the present invention.

Here, the control performed at S55 is described in detail with reference to the flowchart of FIG. 7. First at S61, the PCM 8 adjusts the opening of the flow rate control valve 6 with respect to the second auxiliary flow path 3*a* to reach a predetermined opening which is below a first target opening (e.g., about ⅓ of the first target opening, see A2 in FIG. 8). Note that the "first target opening" used here is a target opening for the warmed-up state, and means a largest opening (fully opened state) of the flow rate control valve 6 with respect to the second auxiliary flow path 3*a*.

Thus, a small amount of coolant starts to flow into the second auxiliary flow path 3*a*, and the coolant flowed through the second auxiliary flow path 3*a* flows into the first flow path 2 via the coolant pump 5. In other words, the flow rate of the coolant flowing through the upstream flow path 2*b* of the first flow path 2 is the sum of the flow rate of the coolant flowing through the first auxiliary flow path 2*a* (path (1)) and the flow rate of the coolant flowing through the second auxiliary flow path 3*a* (path (2)), which means the flow rate increases compared to that at S53 (see A3 in FIG. 9). However, since the opening of the flow rate control valve 6 with respect to the second auxiliary flow path 3*a* is not immediately fully opened, but opened to, for example, about ⅓ of the fully opened state, the flow rate restriction of the coolant at the first flow path 2 is started to be gradually canceled.

Then, the PCM 8 determines whether the temperature T detected by the coolant temperature sensor 7 is the same or above a third temperature threshold T3 (e.g., 75° C., see FIG. 8) which is above the first temperature threshold T1 but below the second temperature threshold T2 (S62).

If the temperature T is determined to be the same or above the third temperature threshold T3 (S62: YES), at S63, the PCM 8 adjusts the opening of the flow rate control valve 6 with respect to the second auxiliary flow path 3*a* to reach the first target opening for the warmed-up state (see A4 in FIG. 8). Thus, the flow rate of the coolant flowing through the second auxiliary flow path 3*a* (path (2)) is increased to a target flow rate for the warmed-up state (a largest flow rate for the second auxiliary flow path 3*a*), and accordingly the flow rate of the coolant flowing through the upstream flow path 2*b* of the first flow path 2 is also increased (see A5 in FIG. 9). Since the flow rate is gradually increased in two steps of S61 and S63, the flow rate restriction in the first flow path 2 is started to be gradually canceled (second flowing state in FIG. 9).

Returning to FIG. 6, if the temperature T is determined to be the second temperature threshold T2 or higher (S54: NO), at S56, the PCM 8 determines whether the temperature T is below a fourth temperature threshold T4 (e.g., 95° C., see FIG. 8). Note that the fourth temperature threshold T4 is above the third temperature threshold T3.

If the temperature T is determined to be below the fourth temperature threshold T4 (S56: YES), the PCM 8 increases the opening of the flow rate control valve 6 with respect to the third flow path 4 (S57). Then, the control returns to S51.

Here, the control performed at S57 is described in detail with reference to the flowchart of FIG. 7. First at S61, the PCM 8 adjusts the opening of the flow rate control valve 6 with respect to the third flow path 4 to reach a predetermined opening which is below a second target opening (e.g., about ½ of the second target opening, see A6 in FIG. 8). Thus, a small amount of coolant starts to flow into the third flow path 4, and the coolant flowed through the third flow path 4 flows into the first and third flow paths 2 and 4 via the coolant pump 5 (see A7 in FIG. 9). Note that the "second target opening" used here is a target opening for the warmed-up state, and means a largest opening (fully opened state) of the flow rate control valve 6 with respect to the third flow path 4.

Then, the PCM 8 determines whether the temperature T detected by the coolant temperature sensor 7 is the same or above a fifth temperature threshold T5 (e.g., 85° C., see FIG. 8) which is above the second temperature threshold T2 but below the fourth temperature threshold T4 (S62).

If the temperature T is determined to be the same or above the fifth temperature threshold T5 (S62: YES), at S63, the PCM 8 adjusts the opening of the flow rate control valve 6 with respect to the third flow path 4 to reach the second target opening (see A8 in FIG. 8, A9 in FIG. 9). Thus, the flow rate of the coolant flowing through the third flow path 4 (path (3)) is increased to a target flow rate for the warmed-up state (a largest flow rate for the third flow path 4). In other words, the flow rate of the coolant flowing out from the third flow path 4 is gradually increased in two steps of S61 and S63 (third flowing state in FIG. 9).

Returning to FIG. 6, if the temperature T is determined to be the fourth temperature threshold T4 or higher (S56: NO), at S58, the PCM 8 increases the opening of the flow rate control valve 6 with respect to the third auxiliary flow path 3*b*. Then, the control returns to S51.

Here, the control performed at S58 is described in detail with reference to the flowchart of FIG. 7. First at S61, the PCM 8 adjusts the opening of the flow rate control valve 6 with respect to the third auxiliary flow path 3*b* to reach a predetermined opening which is below a third target opening (e.g., about ½ of the third target opening, see A10 in FIG. 8). Note that the "third target opening" used here is a target opening for the warmed-up state, and means a largest opening (fully opened state) of the flow rate control valve 6 with respect to the third auxiliary flow path 3*b*.

Figure 9:
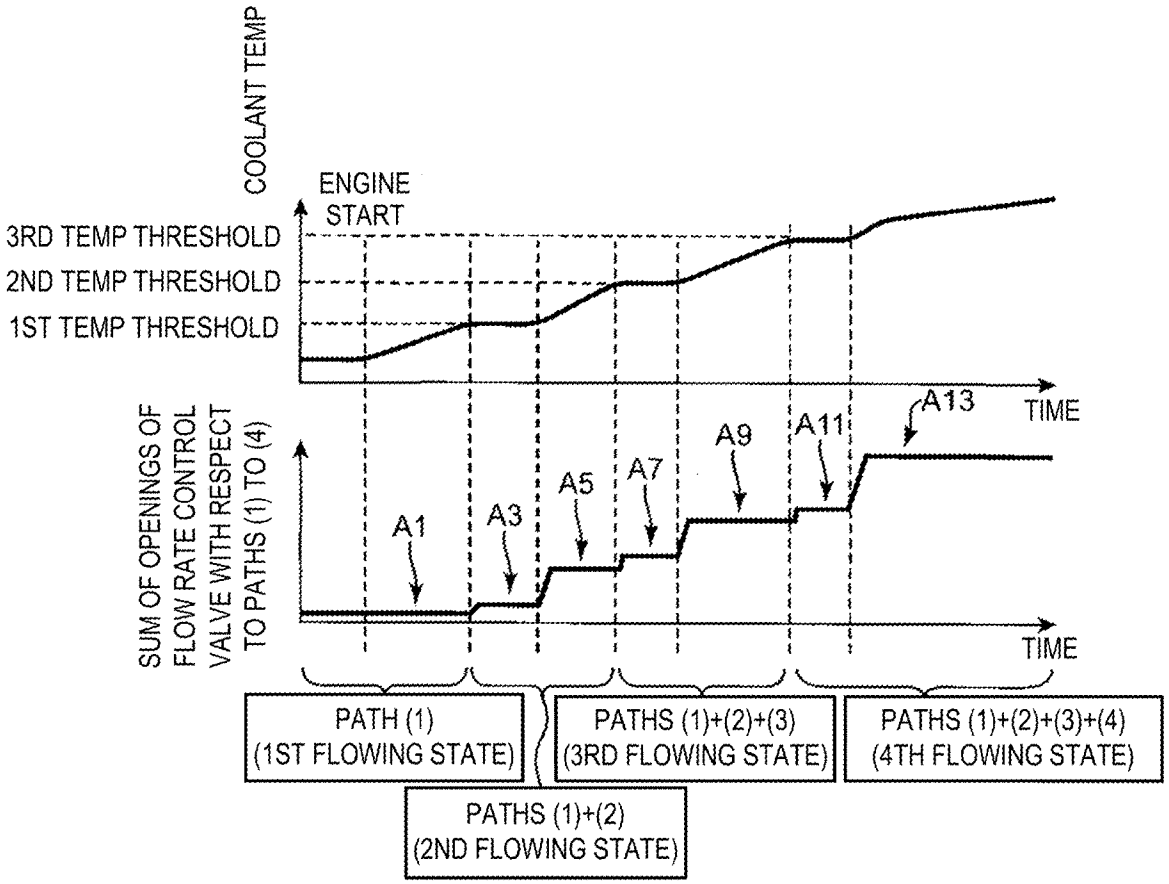
FIG. 9 shows charts illustrating a temperature change of the coolant (upper chart) and a change of sum of the openings of the flow rate control valve with respect to the respective flow paths (lower chart), when cancellation of a flow rate restriction for each of the coolant flow paths is performed in a stepwise fashion according to the embodiment of the present invention.

Thus, the flow rate of the coolant flowing through the upstream flow path 2*b* of the first flow path 2 increases compared to that at S55 (see A11 in FIG. 9). However, since the opening of the flow rate control valve 6 with respect to the third auxiliary flow path 3*b* is not immediately fully opened, but opened to, for example, about ½ of the fully opened state, the flow rate restriction of the coolant at the first flow path 2 is started to be gradually canceled.

Then, the PCM 8 determines whether the temperature T detected by the coolant temperature sensor 7 is the same or above a sixth temperature threshold T6 (e.g., 100° C., see FIG. 8) which is above the fourth temperature threshold T4 (S62).

If the temperature T is determined to be the same or above the sixth temperature threshold T6 (S62: YES), at S63, the PCM 8 adjusts the opening of the flow rate control valve 6 with respect to the third auxiliary flow path 3*b* to reach the third target opening for the warmed-up state (see A12 in FIG. 8). Thus, the flow rate of the coolant flowing through the third auxiliary flow path 3*b* (path (4)) is increased to a target flow rate for the warmed-up state (a largest flow rate for the third auxiliary flow path 3*b*), and accordingly the flow rate of the coolant flowing through the first flow path 2 is also increased (see A13 in FIG. 9). In other words, since the flow rate is gradually increased in two steps of S61 and S63, the flow rate restriction in the first flow path 2 is started to be gradually canceled (fourth flowing state in FIG. 9).

Figure 10:
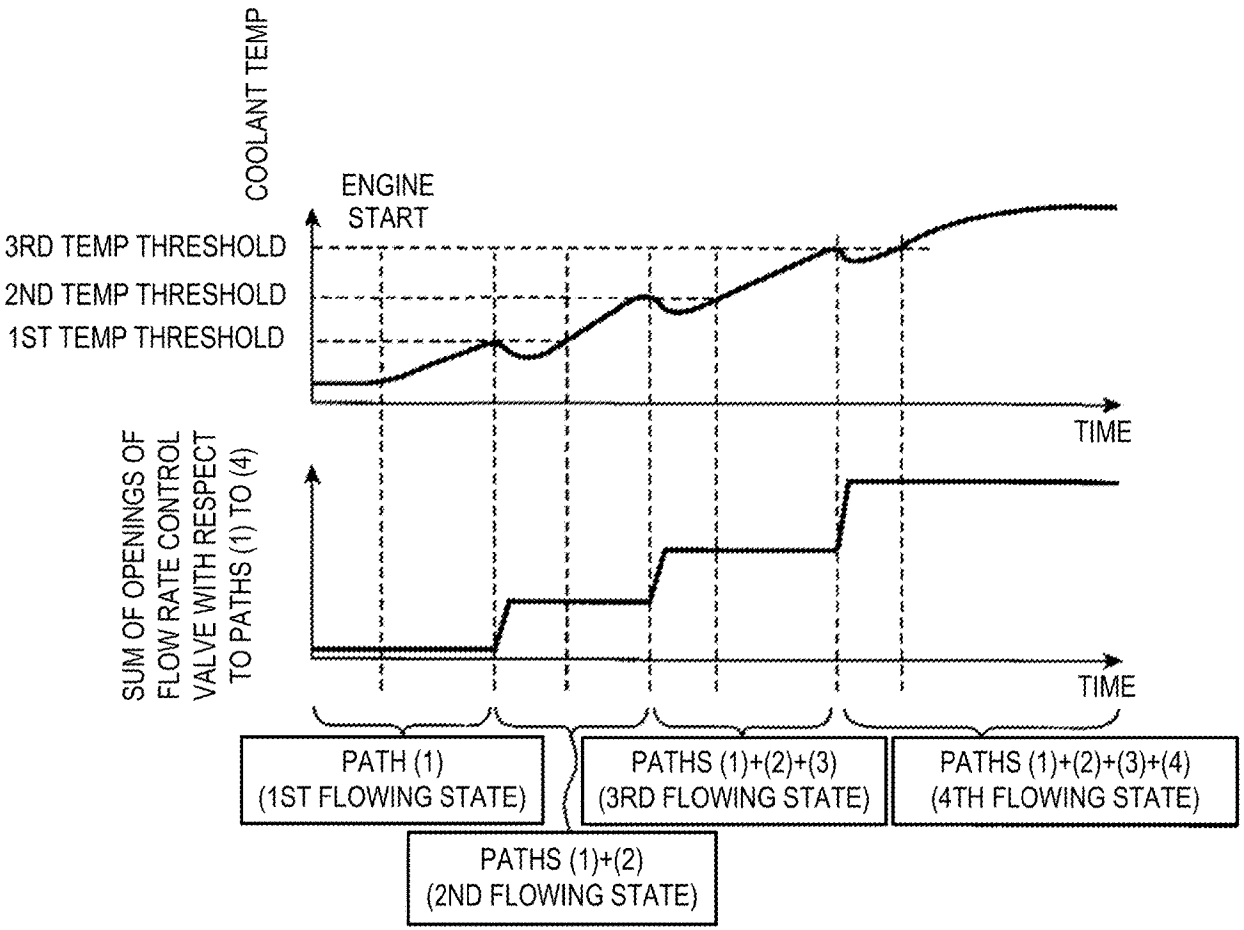
FIG. 10 shows charts illustrating a temperature change of the coolant (upper chart) and a change of sum of the openings of the flow rate control valve with respect to the respective flow paths (lower chart), when cancellation of the flow rate restriction for each of the coolant flow paths is not performed in a stepwise fashion.

In this regard, as illustrated in FIG. 10, if the opening of the flow rate control valve 6 with respect to the second auxiliary flow path 3*a* is shifted from the fully closed state to the fully opened state, the low-temperature coolant stagnated within the second auxiliary flow path 3*a* flows into the first flow path 2 at once and the temperature of the coolant at the cylinder head 9*b* decreases. Further, if the opening of the flow rate control valve 6 with respect to the third auxiliary flow path 3*b* is shifted from the fully closed state to the fully opened state, the low-temperature coolant stagnated within the third auxiliary flow path 3*b* flows into the first flow path 2 at once and the temperature of the coolant at the cylinder head 9*b* decreases. Moreover, if the opening of the flow rate control valve 6 with respect to the third flow path 4 is shifted from the fully closed state to the fully opened state, the low-temperature coolant stagnated within the third flow path 4 flows into the first flow path 2 at once and the temperature of the coolant at the cylinder head 9*b* decreases. Thus, when the temperature of the coolant at the cylinder head 9*b* decreases, the warming up of the engine 9 may not be performed smoothly.

As described above, according to this embodiment, when the temperature of the coolant flowing through the cylinder head 9*b* is below the first temperature threshold T1, since the openings of the flow rate control valve 6 with respect to the second and third auxiliary flow paths 3*a* and 3*b* are adjusted to zero, the flow rate of the coolant flowing through the cylinder head 9*b* is restricted and the warming up of the engine 9 is stimulated.

When the temperature of the coolant flowing through the cylinder head 9*b* is the first temperature threshold T1 or higher, since the openings of the flow rate control valve 6 with respect to the second and third auxiliary flow paths 3*a* and 3*b* are increased to the predetermined target openings in the stepwise fashion, respectively, the flow rate restriction of the coolant flowing through the cylinder head 9*b* is gradually canceled and the temperature decrease (overcooling) of the cylinder head 9*b* can be suppressed.

In other words, when the openings of the flow rate control valve 6 with respect to the second and third auxiliary flow paths 3*a* and 3*b* are zero, the coolant within the second and third auxiliary flow paths 3*a* and 3*b* does not flow. Therefore, the coolant warmed up by the heat of the engine 9 after the cold start does not flow into the second and third auxiliary flow paths 3*a* and 3*b*, and the temperatures of the coolant within the second and third auxiliary flow paths 3*a* and 3*b* are comparatively low. When the opening of the flow rate control valve 6 with respect to the second auxiliary flow path 3*a* is increased (the flow rate control valve 6 is opened) in such a state, the coolant starts to flow through the second auxiliary flow paths 3*a*, and the comparatively low-temperature coolant within the second auxiliary flow path 3*a* flows into the first flow path 2. Further, when the opening of the flow rate control valve 6 with respect to the third auxiliary flow path 3*b* is increased (the flow rate control valve 6 is opened) in such a state, the coolant starts to flow through the third auxiliary flow path 3*b*, and the comparatively low-temperature coolant within the third auxiliary flow path 3*b* flows into the first flow path 2. However, since the openings of the flow rate control valve 6 are increased in the stepwise fashion, the flow rate restriction of the coolant flowing through the cylinder head 9*b* is gradually canceled and the amount of comparatively low-temperature coolant flowing into the cylinder head 9*b* is gradually increased. Therefore, the overcooling of the cylinder head 9*b* is suppressed and the sufficient ignitability of the engine 9 after the cold start can be maintained.

Since the opening of the flow rate control valve 6 with respect to the first auxiliary flow path 2*a* is constantly maintained at a predetermined small opening around zero, a small amount of coolant constantly flows into the first auxiliary flow path 2*a*. Therefore, by disposing the auxiliary machinery which requires constant cooling by the coolant (e.g., the high-pressure EGR valve 11*a*, the intake shutter valve 11*b*) at the first auxiliary flow path 2*a*, the overheating of the auxiliary machinery can be prevented.

Since the flow rate control valve 6 is opened to be maintained at the predetermined openings below the respective target openings for a while, the low-temperature coolant remaining within the second and third auxiliary flow paths 3*a* and 3*b* and the third flow path 4 is gradually supplied to the cylinder head 9*b*. Therefore, the overcooling of the cylinder head 9*b* after the cold start can be suppressed and the warming up of the engine 9 can be stimulated.

Although the heat of the coolant within the second auxiliary flow path 3*a* is taken by the heater core 11*e*, since the coolant is gradually supplied to the cylinder head 9*b*, the overcooling of the cylinder head 9*b* after the cold start can be suppressed.

Although the heat of the coolant within the third auxiliary flow path 3*b* is released through the radiator 11*f*, since the coolant is gradually supplied to the cylinder head 9*b*, the overcooling of the cylinder head 9*b* after the cold start can be suppressed.

By increasing the opening of the flow rate control valve 6 with respect to the third flow path 4 in the stepwise fashion, the low-temperature coolant remaining within the third flow path 4 when the opening of the flow rate control valve 6 with respect to the third flow path 4 is zero is gradually supplied to the cylinder head 9*b* and the cylinder block 9*a*, and therefore, the overcooling of the cylinder head 9*b* and the cylinder block 9*a* after the cold start can be suppressed.

Since the rotary valve with which the coolant flow rate becomes higher as the opening thereof is increased is used as the flow rate control valve 6, the flow rate can easily be controlled.

Note that, in this embodiment, the flow rate of the coolant through the first flow path 2 is restricted by adjusting the openings of the flow rate control valve 6 with respect to the second and third auxiliary flow paths 3*a* and 3*b* to zero; however, it is not limited to this. For example, the flow rate of the coolant through the first flow path 2 may be restricted by adjusting the openings of the flow rate control valve 6 with respect to the second and third auxiliary flow paths 3*a* and 3*b* to predetermined small openings around zero. Moreover, the flow rate of the coolant through the first flow path 2 may be restricted by adjusting the opening of the flow rate control valve 6 with respect to one of the second and third auxiliary flow paths 3*a* and 3*b* to zero and the opening of the flow rate control valve 6 with respect to the other one of the second and third auxiliary flow paths 3*a* and 3*b* to the predetermined small opening around zero.

In this embodiment, in the second, third, and fourth flowing states, the openings of the flow rate control valve 6 are increased to the respective predetermined target openings for the warmed-up state in the two steps; however, it is not limited to this. For example, the openings of the flow rate control valve 6 may be increased to the target openings in three or more steps.

In this embodiment, the openings of the flow rate control valve 6 are increased to the respective predetermined target openings for the warmed-up state in the stepwise fashion; however, it is not limited to this. For example, the openings of the flow rate control valve 6 may be gradually and continuously increased to the target openings.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

| | |
|---|---|
| 1 | Cooling System of Engine |
| 2 | First Flow Path |
| 2a | First Auxiliary Flow Path |
| 3 | Second Flow Path |
| 3a | Second Auxiliary Flow Path |
| 3b | Third Auxiliary Flow Path |
| 4 | Third Flow Path |
| 5 | Coolant Pump |
| 5a | Input Port of Coolant Pump |
| 5b | Output Port of Coolant Pump |
| 6 | Flow Rate Control Valve |
| 7 | Coolant Temperature Sensor |
| 8 | PCM |
| 9 | Engine |
| 9a | Cylinder Block |
| 9b | Cylinder Head |
| 11a-11f | Auxiliary Machinery |
| 11a | High-pressure EGR Valve |
| 11b | Intake Shutter Valve |
| 11c | Low-pressure EGR Cooler |
| 11d | Low-pressure EGR Valve |
| 11e | Heater Core |
| 11f | Radiator |
| 11g | Oil Cooler |
| 11h | ATF Cooler |

What is claimed is:

1. A cooling system for an engine, comprising:

coolant flow paths including a first flow path and a second flow path and where coolant circulates, the first flow path passing through a cylinder head of the engine, and the second flow path branching from the first flow path and passing through auxiliary machinery of the engine;

a coolant pump for circulating the coolant within the coolant flow paths;

a flow rate control valve for adjusting a flow rate of the coolant through the second flow path;

a temperature detector for detecting a temperature of the coolant within the first flow path; and a valve controller for adjusting an opening of the flow rate control valve based on the temperature detected by the temperature detector, wherein when the detected temperature is below a predetermined lower temperature threshold, the valve controller adjusts the opening of the flow rate control valve to one of zero and a predetermined small opening around zero, and the valve controller increases the opening of the flow rate control valve in a stepwise fashion, by opening the flow rate control valve to the second flow path at a predetermined opening above zero that is below a fully opened predetermined second flow path target opening and maintaining the predetermined opening while the detected temperature is above the predetermined lower temperature threshold and below a predetermined upper temperature threshold, and when the detected temperature exceeds the predetermined upper temperature threshold while the predetermined opening of the flow rate control valve is being maintained, the valve controller opens the flow rate control valve to the second flow path to reach the predetermined second flow path target opening.

2. The cooling system of claim 1, wherein the auxiliary machinery of the engine is disposed at a downstream flow path of the first flow path, the downstream flow path located downstream of the branching point between the first and second flow paths, and wherein the flow rate control valve is connected with the downstream flow path and constantly maintains the opening of the valve with respect to the downstream flow path at a predetermined small opening around zero.

3. The cooling system of claim 1, wherein the auxiliary machinery disposed at the second flow path includes a heater core.

4. The cooling system of claim 3, wherein the auxiliary machinery disposed at the second flow path includes a radiator.

5. The cooling system of claim 4, wherein the coolant flow paths also include a third flow path passing through a cylinder block of the engine, wherein the flow rate control valve adjusts the flow rate of the coolant through the second and third flow paths, and wherein when the detected temperature is below a predetermined temperature threshold for the third flow path, the valve controller adjusts the opening of the flow rate control valve with respect to the third flow path to one of zero and a predetermined small opening around zero, and when the detected temperature is one of the predetermined temperature threshold for the third flow path and a value thereabove, the valve controller increases the opening of the flow rate control valve with respect to the third flow path to a predetermined third flow path target opening for the third flow path in one of the stepwise fashion and a continuous and gradual fashion, the predetermined temperature threshold for the third flow path being a value above a target threshold for the first flow path.

6. The cooling system of claim 3, wherein the coolant flow paths also include a third flow path passing through a cylinder block of the engine, wherein the flow rate control valve adjusts the flow rate of the coolant through the second and third flow paths, and wherein when the detected temperature is below a predetermined temperature threshold for the third flow path, the valve controller adjusts the opening of the flow rate control valve with respect to the third flow path to one of zero and a predetermined small opening around zero, and when the detected temperature is one of the predetermined temperature threshold for the third flow path and a value thereabove, the valve controller increases the opening of the flow rate control valve with respect to the third flow path to a predetermined third flow path target opening for the third flow path in one of the stepwise fashion and a continuous and gradual fashion, the predetermined temperature threshold for the third flow path being a value above a target threshold for the first flow path.

7. The cooling system of claim 2, wherein the auxiliary machinery disposed at the second flow path includes a heater core.

8. The cooling system of claim 7, wherein the flow rate control valve is a rotary valve for increasing the flow rate of the coolant by increasing an opening thereof.

9. The cooling system of claim 2, wherein the auxiliary machinery disposed at the second flow path includes a radiator.

10. The cooling system of claim 2, wherein the coolant flow paths also include a third flow path passing through a cylinder block of the engine, wherein the flow rate control valve adjusts the flow rate of the coolant through the second and third flow paths, and wherein when the detected temperature is below a predetermined temperature threshold for the third flow path, the valve controller adjusts the opening of the flow rate control valve with respect to the third flow path to one of zero and a predetermined small opening around zero, and when the detected temperature is one of the predetermined temperature threshold for the third flow path and a value thereabove, the valve controller increases the opening of the flow rate control valve with respect to the third flow path to a predetermined third flow path target opening for the third flow path in one of the stepwise fashion and a continuous and gradual fashion, the predetermined temperature threshold for the third flow path being a value above a target threshold for the first flow path.

11. The cooling system of claim 1, wherein the auxiliary machinery disposed at the second flow path includes a radiator.

12. The cooling system of claim 1, wherein the coolant flow paths also include a third flow path passing through a cylinder block of the engine, wherein the flow rate control valve adjusts the flow rate of the coolant through the second and third flow paths, and wherein when the detected temperature is below a predetermined temperature threshold for the third flow path, the valve controller adjusts the opening of the flow rate control valve with respect to the third flow path to one of zero and a predetermined small opening around zero, and when the detected temperature is one of the predetermined temperature threshold for the third flow path and a value thereabove, the valve controller increases the opening of the flow rate control valve with respect to the third flow path to a predetermined third flow path target opening for the third flow path in one of the stepwise fashion and a continuous and gradual fashion, the predetermined temperature threshold for the third flow path being a value above a target threshold for the first flow path.

13. The cooling system of claim 1, wherein the auxiliary machinery disposed at the second flow path includes a heater core.

14. The cooling system of claim 1, wherein the auxiliary machinery disposed at the second flow path includes a radiator.

15. The cooling system of claim 1, wherein the coolant flow paths also include a third flow path passing through a cylinder block of the engine, wherein the flow rate control valve adjusts the flow rate of the coolant through the second and third flow paths, and wherein when the detected temperature is below a predetermined temperature threshold for the third flow path, the valve controller adjusts the opening of the flow rate control valve with respect to the third flow path to one of zero and a predetermined small opening around zero, and when the detected temperature is one of the predetermined temperature threshold for the third flow path and a value thereabove, the valve controller increases the opening of the flow rate control valve with respect to the third flow path to a predetermined third flow path target opening for the third flow path in one of the stepwise fashion and a continuous and gradual fashion, the predetermined temperature threshold for the third flow path being a value above a target threshold for the first flow path.

16. The cooling system of claim 1, wherein the flow rate control valve is a rotary valve for increasing the flow rate of the coolant by increasing an opening thereof.

* * * * *